US010163588B2

(12) United States Patent
Kubono et al.

(10) Patent No.: US 10,163,588 B2
(45) Date of Patent: Dec. 25, 2018

(54) ELECTROMAGNETIC RELAY INCLUDING YOKE-RETAINING BOTTOM PLATE

(71) Applicant: FUJITSU COMPONENT LIMITED, Tokyo (JP)

(72) Inventors: Kazuo Kubono, Tokyo (JP); Yoichi Hasegawa, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 69 days.

(21) Appl. No.: 15/177,485

(22) Filed: Jun. 9, 2016

(65) Prior Publication Data

US 2016/0372286 A1 Dec. 22, 2016

(30) Foreign Application Priority Data

Jun. 19, 2015 (JP) ..... 2015-123926

(51) Int. Cl.

| | |
|---|---|
| ***H01H 50/36*** | (2006.01) |
| ***H01H 9/44*** | (2006.01) |
| ***H01H 50/24*** | (2006.01) |
| ***H01H 50/38*** | (2006.01) |
| *H01H 50/60* | (2006.01) |
| *H01H 50/14* | (2006.01) |

(52) U.S. Cl.

CPC ..... *H01H 9/443* (2013.01); *H01H 50/24* (2013.01); *H01H 50/38* (2013.01); *H01H 50/14* (2013.01); *H01H 50/60* (2013.01)

(58) Field of Classification Search

CPC ..... H01H 50/36; H01H 33/182; H01H 50/02; H01H 50/60; H01H 50/14; H01H 50/24; H01H 50/38; H01H 9/443

USPC ..... 335/187

See application file for complete search history.

(56) References Cited

U.S. PATENT DOCUMENTS

| | | | | |
|---|---|---|---|---|
| 3,256,401 | A * | 6/1966 | Dawson | H01H 51/06 200/283 |
| 4,112,400 | A * | 9/1978 | Jaidinger | H01H 50/041 335/128 |
| 2010/0182111 | A1* | 7/2010 | Hagihara | H01H 50/005 335/203 |
| 2014/0022035 | A1* | 1/2014 | Yamashita | H01H 9/443 335/201 |

FOREIGN PATENT DOCUMENTS

| | | |
|---|---|---|
| EP | 0902452 | 11/2004 |
| JP | H10-255633 | 9/1998 |

(Continued)

*Primary Examiner* — Bernard Rojas

(74) *Attorney, Agent, or Firm* — IPUSA, PLLC

(57) ABSTRACT

An electromagnetic relay includes a base, a fixed contact terminal including a fixed contact, and fixed to the base, a movable contact terminal including a movable contact that contacts the fixed contact, an electromagnet that generates a magnetic field when an electric current flows through a coil wrapped around an iron core, an armature connected to the movable contact terminal, and moved by a magnetic force generated in the electromagnet, a yoke including a vertical part, and a horizontal part connected to the iron core, and a bottom plate formed of an insulator, and covering a surface of the horizontal part facing away from the iron core. The bottom plate includes a yoke insertion part into which the horizontal part is inserted in a direction parallel to the horizontal part.

8 Claims, 17 Drawing Sheets

(56) References Cited

FOREIGN PATENT DOCUMENTS

| | | |
|---|---|---|
| JP | H11-111143 | 4/1999 |
| JP | 2006-210289 | 8/2006 |
| JP | 2014-049315 | 3/2014 |

* cited by examiner

ELECTROMAGNETIC RELAY INCLUDING YOKE-RETAINING BOTTOM PLATE

CROSS-REFERENCE TO RELATED APPLICATION

The present application is based upon and claims the benefit of priority of Japanese Patent Application No. 2015-123926, filed on Jun. 19, 2015, the entire contents of which are incorporated herein by reference.

BACKGROUND OF THE INVENTION

1. Field of the Invention

The present invention relates to electromagnetic relays.

2. Description of the Related Art

Electromagnetic relays turn on or off electric current by causing electric current to flow through a coil to generate a magnetic field, thereby causing the movable contact to move to come into or out of contact with a fixed contact.

For related art, reference may be made to, for example, Japanese Laid-Open Patent Application Nos. 10-255633, 2006-210289, 11-111143, and 2014-49315.

SUMMARY OF THE INVENTION

According to an aspect of the present invention, an electromagnetic relay includes a base, a fixed contact terminal including a fixed contact, and fixed to the base, a movable contact terminal including a movable contact that contacts the fixed contact, an electromagnet that generates a magnetic field when an electric current flows through a coil wrapped around an iron core, an armature connected to the movable contact terminal, and moved by a magnetic force generated in the electromagnet, a yoke including a vertical part, and a horizontal part connected to the iron core, and a bottom plate formed of an insulator, and covering a surface of the horizontal part facing away from the iron core. The bottom plate includes a yoke insertion part into which the horizontal part is inserted in a direction parallel to the horizontal part.

DESCRIPTION OF THE EMBODIMENTS

Figure 1:
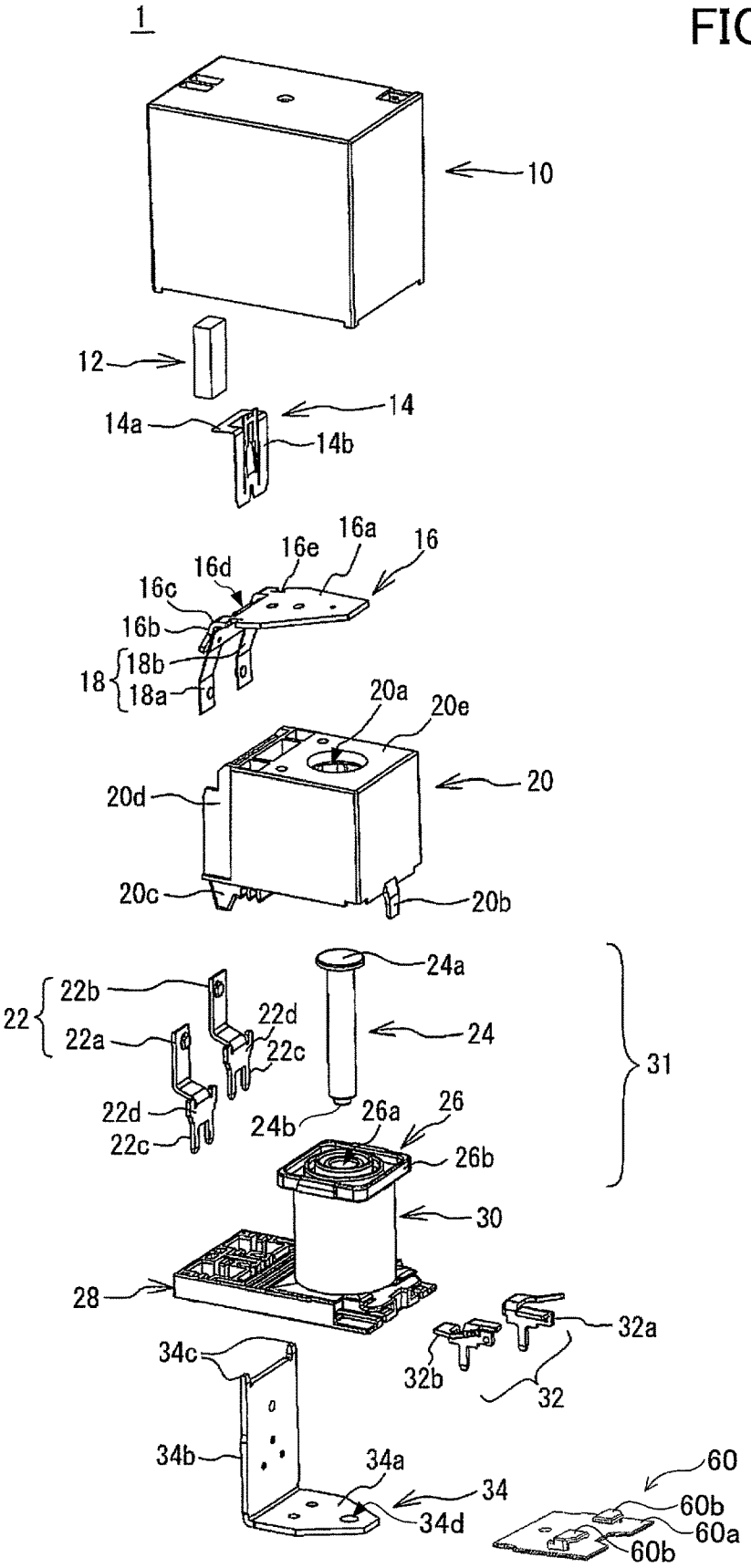
FIG. 1 is an exploded perspective view of an electromagnetic relay according to an embodiment.

If an interconnect formed on a printed circuit board contacts an electrically conductive part of an electromagnetic relay mounted on the printed circuit board, the electronic circuit may malfunction or the operation of the electronic circuit may be adversely affected. Accordingly, some electromagnetic relays include an insulating member for preventing contact with interconnects by applying an insulating adhesive.

In the case of forming an insulating member with an insulating adhesive, however, manufacturing processes increase, thus incurring a cost increase.

According to an aspect of the invention, the reliability of an electromagnetic relay is increased by forming an insulating material on the electromagnetic relay at low cost.

Embodiments of the present invention are described below with reference to the drawings. In the following description, the same elements are referred to using the same reference numeral, and are not repetitively described.

Figure 2:
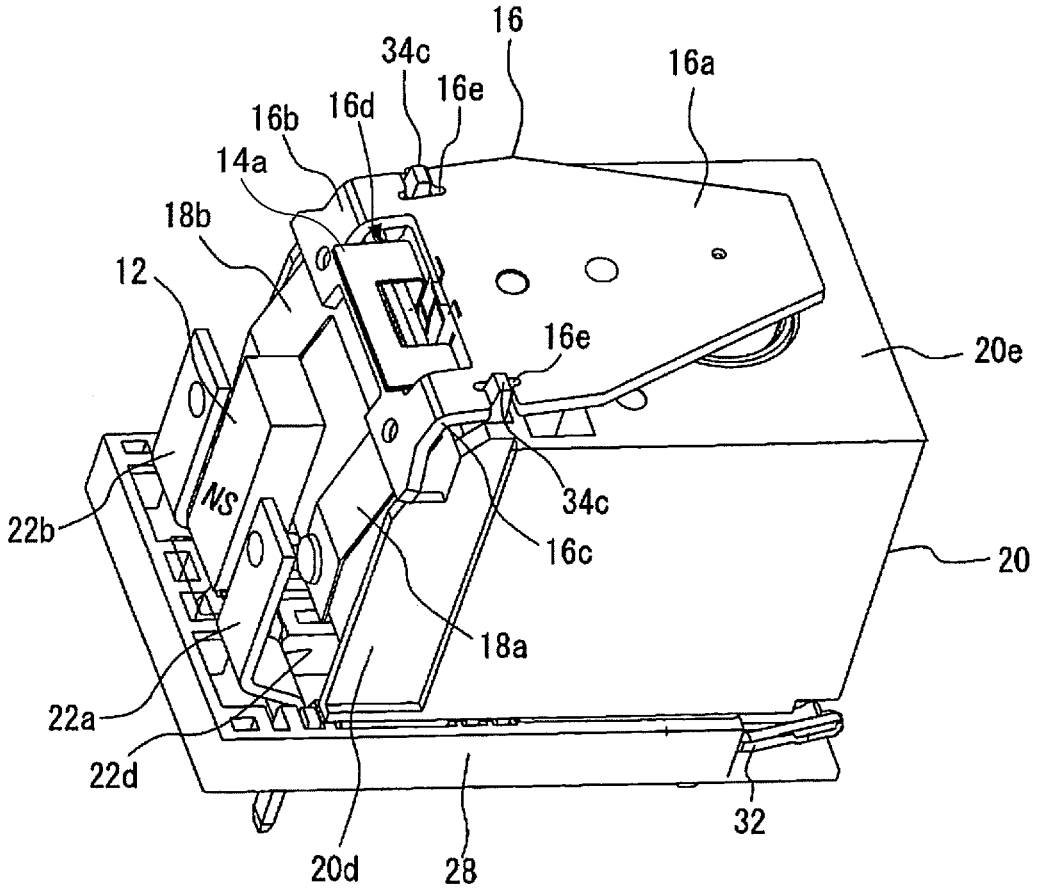
FIG. 2 is a perspective view of the electromagnetic relay according to this embodiment.

FIG. 1 and FIG. 2 are an exploded perspective view and a perspective view, respectively, of an electromagnetic relay (hereinafter "relay") according to an embodiment.

A relay 1 according to this embodiment supports direct-current (DC) high voltage, and may be used for, for example, battery precharge of electric vehicles. Hereinafter, the DC high voltage does not only mean the high voltage defined by the International Electrotechnical Commission (IEC), but may include voltage that exceeds 12 VDC or 24 VDC used in common car batteries.

The relay 1 is required to reliably extinguish an arc generated between contacts when the supply of electric power of DC high voltage is interrupted. Furthermore, while the polarities of the load-side connection are generally designated in relays that support DC high voltage, it is required not to designate the polarities of the load-side connection of battery precharge relays, because the direction of electric current reverses between the time of charging and the time of discharging a battery. Accordingly, the relay 1 is required to extinguish an arc irrespective of the direction of a flow of electric current between a movable contact and a fixed contact. The relay 1 according to this embodiment may be used not only for electric vehicles but also for various apparatuses and facilities that are subjected to control of the supply of electric power.

Referring to FIG. 1, the relay 1 includes a case 10, a permanent magnet (hereinafter "magnet") 12 for magnetic arc extinction, a hinge spring 14, an armature 16, a movable contact spring 18 (an example of a movable contact terminal), an insulating cover 20, fixed contact terminals 22 (22*a* and 22*b*), a base 28, coil terminals 32 (32*a* and 32*b*), a yoke 34, and a bottom plate 60. An electric current is supplied to a coil 30 through the coil terminals 32*a* and 32*b* to excite an electromagnet 31 that includes an iron core ("core") 24, a spool 26, and the coil 30.

Figure 3:
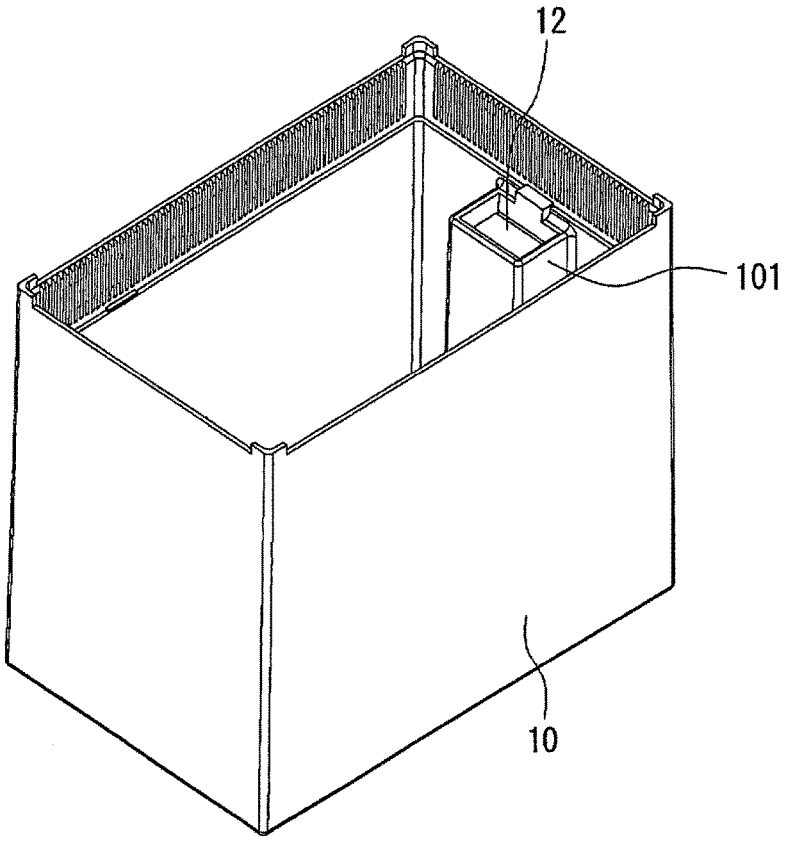
FIG. 3 is a diagram depicting a case.

FIG. 3 is a diagram depicting the case 10. Referring to FIG. 3, a holder 101 for receiving the magnet 12 is formed in the case 10. The magnet 12 placed into the holder 101 is positioned between the fixed contact terminals 22*a* and 22*b*, as depicted in FIG. 2. In FIG. 2, a depiction of the case 10 is omitted.

Referring to FIG. 2, the magnet 12 has a north pole surface oriented toward the fixed contact terminal 22*b* and a south pole surface oriented toward the fixed contact terminal 22*a*. The positions of the north pole surface and the south pole surface may be exchanged. A samarium-cobalt magnet, which has good remanence, coercivity, and heat resistance, may be used as the magnet 12. The samarium-cobalt magnet which is more heat-resistant than a neodymium magnet is preferable, because the heat of an arc is transmitted to the magnet 12.

The hinge spring 14 is oriented to have an inverted L shape in a side view. Referring to FIG. 1, the hinge spring 14 includes a horizontal part 14*a* and a downward extending part 14*b*. The horizontal part 14*a* urges a downward extending part 16*b* of the armature 16 downward. The extending part 14*b* is fixed to a vertical part 34*b* of the yoke 34.

Figure 4:
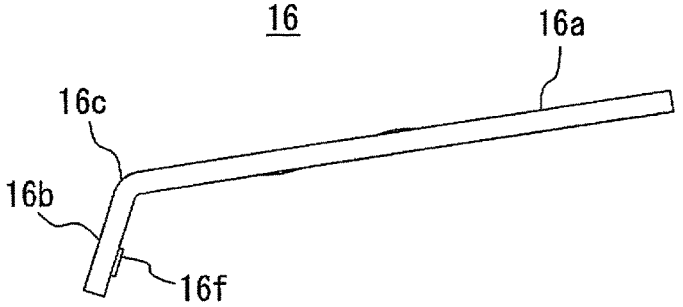
FIG. 4 is a side view of an armature.

The armature 16 is formed of a magnetic material such as iron. FIG. 4 is a side view of the armature 16. As depicted in FIG. 4, the armature 16 has a dogleg shape in a side view, and includes a flat plate part 16*a* and the extending part 16*b*. The plate part 16*a* is attracted to the core 24. The extending part 16*b* extends downward relative to the plate part 16*a* with a bent part 16*c* extending between the plate part 16*a* and the extending part 16*b*. As depicted in FIGS. 1 and 2, the horizontal part 14*a* projects through a through hole 16*d* formed in the center of the bent part 16*c*, and projections 34*c* of the yoke 34 are fit into cuts 16*e* formed in the plate part 16*a*. The extending part 16*b* is provided with projections 16*f* for fixing the movable contact spring 18 to the extending part 16*b*.

The armature 16 turns with the cuts 16*e* fit to the projections 34*c* serving as a support of turning. When an electric current flows through the coil 30, the core 24 attracts the plate part 16*a*. At this point, the horizontal part 14*a* which is in contact with the extending part 16*b* is pressed upward by the extending part 16*b*. When the electric current in the coil 30 is turned off, the extending part 16*b* is pressed downward by the restoring force of the hinge spring 14. As a result, the plate part 16*a* is separated from the core 24. Here, a surface of the plate part 16*a* that faces the core 24 or the cover 20 is referred to as "first surface," and a surface of the plate part 16*a* opposite to its first surface is referred to as "second surface." Furthermore, a surface of the extending part 16*b* that faces the yoke 34 or the cover 20 is referred to as "first surface," and a surface of the extending part 16*b* opposite to its first surface is referred to as "second surface."

Figure 5A:
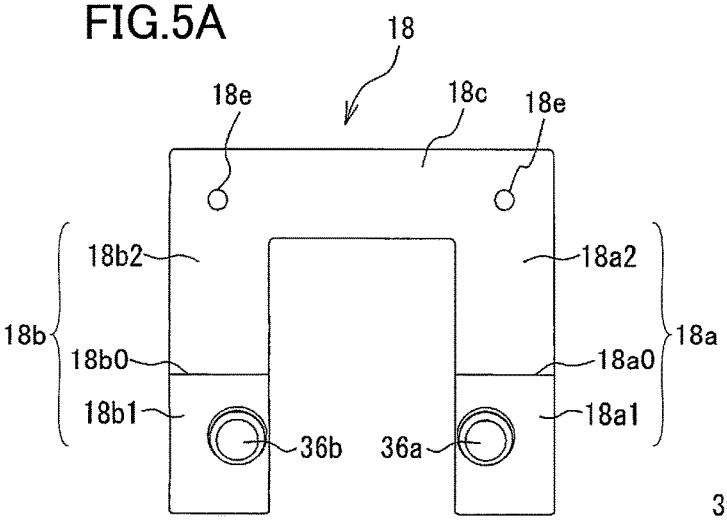
FIGS. 5A and 5B are a front view and a side view, respectively, of a movable contact spring.
Figure 5B:
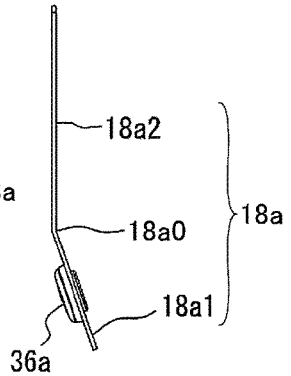
Figure 6A:
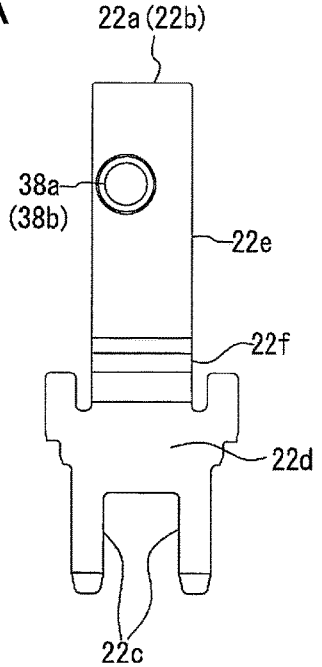
FIGS. 6A and 6B are a front view and a side view, respectively, of fixed contact terminals.
Figure 6B:
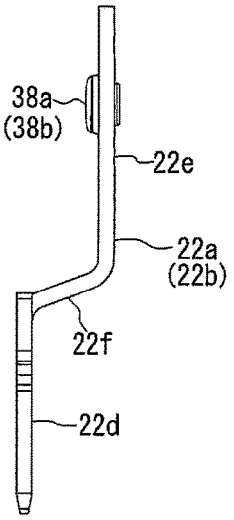

FIGS. 5A and 5B are a front view and a side view, respectively, of the movable contact spring 18. FIGS. 6A and 6B are a front view and a side view, respectively, of the fixed contact terminals 22*a* and 22*b*.

The movable contact spring 18 is formed of an electrically conductive material. The movable contact spring 18 is a leaf spring having an inverted U shape in a front view. The movable contact spring 18 includes a pair of movable pieces, namely, a first movable piece 18*a* and a second movable piece 18*b*, and a connecting part 18*c* that interconnects the upper ends of the first movable piece 18*a* and the second movable piece 18*b*.

The first movable piece 18*a* is bent at a position 18*a*0 between the center and the lower end of the first movable piece 18*a*. Part of the first movable piece 18*a* extending downward from the position 18*a*0 is referred to as "lower part 18*a*1," and part of the first movable piece 18*a* extending upward from the position 18*a*0 is referred to as "upper part 18*a*2." Likewise, the second movable piece 18*b* is bent at a position 18*b*0 between the center and the lower end of the second movable piece 18*b*. Part of the second movable piece 18*b* extending downward from the position 18*b*0 is referred to as "lower part 18*b*1," and part of the second movable piece 18*b* extending upward from the position 18*b*0 is referred to as "upper part 18*b*2."

A movable contact 36*a* formed of a material having good arc resistance is attached to the lower part 18*a*1 of the first movable piece 18*a*. Likewise, a movable contact 36*b* formed of a material having good arc resistance is attached to the lower part 18*b*1 of the second movable piece 18*b*. The first and second movable pieces 18*a* and 18*b* are bent so that the movable contacts 36*a* and 36*b*, attached to the lower parts 18*a*1 and 18*b*1, move away from fixed contacts 38*a* and 38*b*, respectively.

The projections 16*f* provided on the extending part 16*b* are fit into through holes 18*e* formed in the connecting part 18*c*. The projections 16*f* are fit into the through holes 18*e*, and pressed and deformed to hold the movable contact spring 18 against the first surface of the extending part 16*b*, so that the movable contact spring 18 is fixed to the extending part 16*b*.

The fixed contact terminals 22*a* and 22*b* are press-fit from above into through holes formed in the base 28 to be fixed to the base 28. As depicted in FIG. 6B, each of the fixed contact terminals 22*a* and 22*b* is bent like a crank in a side view. Each of the fixed contact terminals 22*a* and 22*b* includes an upper part 22*e*, a lower part 22*d*, and an inclined part 22*f* extending between the upper part 22*e* and the lower part 22*d*. The upper part 22*e*, the inclined part 22*f*, and the lower part 22*d* are monolithically formed. Each of the fixed contact terminals 22*a* and 22*b* has its lower part 22*d* fixed to the base 28. Each of the fixed contact terminals 22*a* and 22*b* is bent so that the upper part 22*e* moves away from the movable contact spring 18 and the cover 20 relative to the lower part 22*d*. The fixed contacts 38*a* and 38*b* formed of a material having good arc resistance are attached to the upper parts 22*e* of the fixed contact terminals 22*a* and 22*b*, respectively. A bifurcated terminal 22*c* which connects to a power supply is provided on the lower part 22*d* of each of the fixed contact terminals 22*a* and 22*b*.

The cover 20 is formed of a resin material. A head 24*a* of the core 24 is exposed through a through hole 20*a* formed in a ceiling 20*e* of the cover 20. Projecting fixation parts 20*b* and 20*c* (first and second fixation parts) for fixing the cover 20 to the base 28 are formed at the bottom of the cover 20. The fixation part 20*b* engages with one end of the base 28. The fixation parts 20*c* are inserted into holes of the base 28. Furthermore, a backstop 20*d* is monolithically formed with the cover 20. The backstop 20*d* contacts the movable contact spring 18 when no electric current flows through the coil 30, that is, when the electromagnet 31 is turned off. The backstop 20*d* prevents the occurrence of the collision noise of the movable contact spring 18 and a metal part, such as the yoke 34. Accordingly, the operating noise of the relay 1 is reduced.

The core 24 is inserted into a through hole 26*a* formed in a head 26*b* of the spool 26. Wire that forms the coil 30 is wrapped around the spool 26 monolithically formed with the base 28. The electromagnet 31 attracts and stops attracting the plate part 16*a* according as the electric current to the coil 30 is turned on and off, so that the movable contact spring 18 makes and breaks contact with the fixed contact terminals 22*a* and 22*b*. The coil terminals 32 are press-fit into the base 28. The wire is twined around the coil terminals 32.

The yoke 34 formed of a magnetic material is oriented to have an L shape in a side view. The yoke 34 includes a horizontal part 34*a*, fixed to the base 28, and the vertical part 34*b*, vertically extending from the horizontal part 34*a*. The vertical part 34*b* is press-fit into a through hole of the base 28 and a through hole of the cover 20 from below the base 28, so that the projections 34*c* which are provided one at each end of the top of the vertical part 34*b* project from the ceiling 20*e* as depicted in FIG. 2.

Figure 7A:
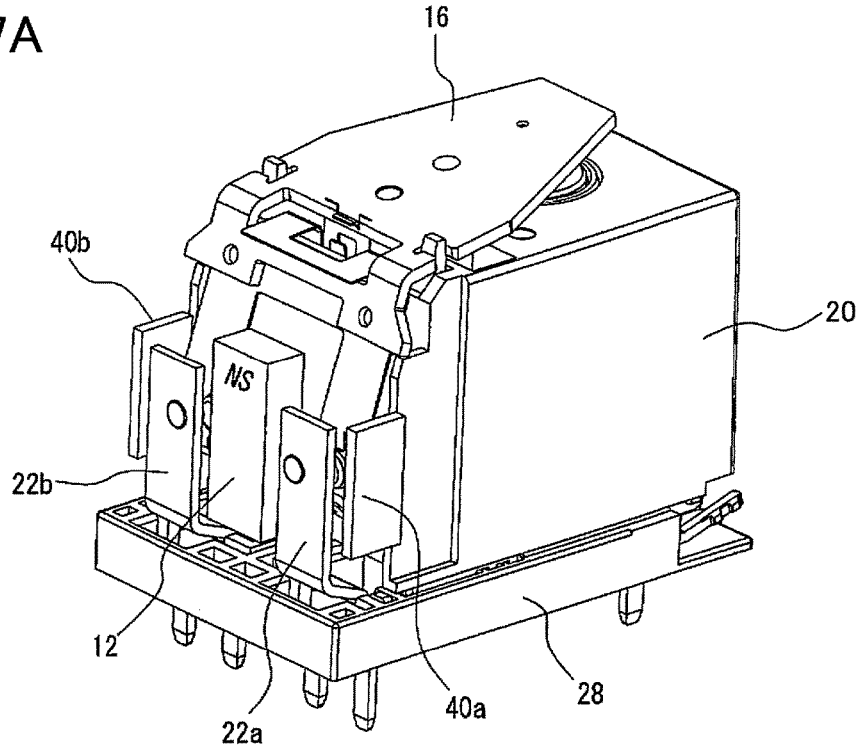
FIG. 7A is a diagram depicting the electromagnetic relay according to a first variation of the embodiment.

To stabilize the direction of the magnetic flux of the magnet 12 to reduce flux leakage, two plate-shaped yokes 40*a* and 40*b* may be additionally provided as depicted in FIG. 7A. The yoke 40*a* is provided to face one magnetic pole surface of the magnet 12 across the fixed contact terminal 22*a*. Thus, the yoke 40*a* and the magnet 12 are on opposite sides of the fixed contact terminal 22*a*. Likewise, the yoke 40*b* is provided to face the other magnetic pole surface of the magnet 12 across the fixed contact terminal 22*b*. Thus, the yoke 40*b* and the magnet 12 are on opposite sides of the fixed contact terminal 22*b*.

Figure 7B:
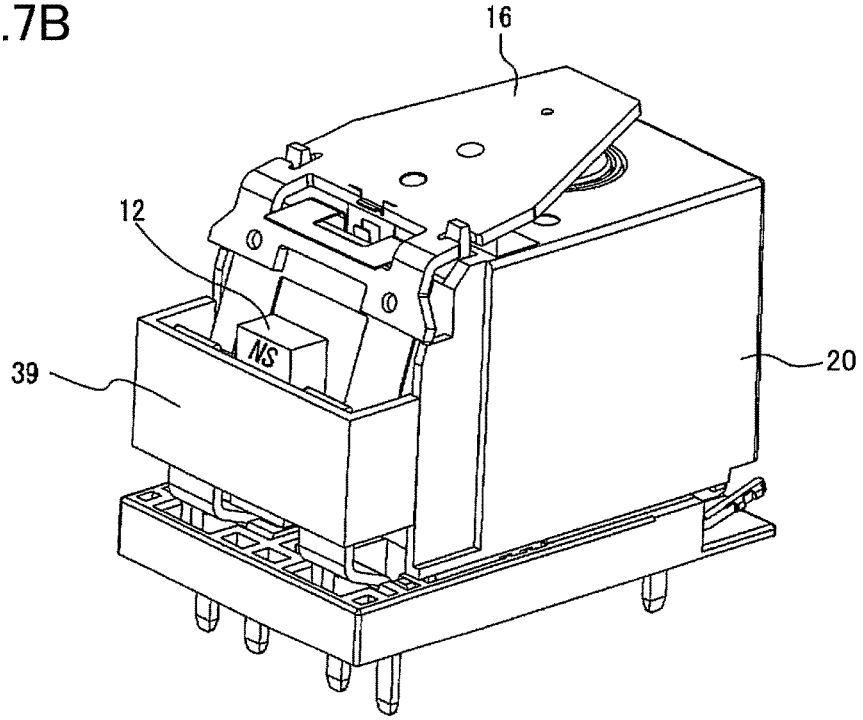
FIG. 7B is a diagram depicting the electromagnetic relay according to a second variation of the embodiment.

Furthermore, to stabilize the direction of the magnetic flux of the magnet 12 to reduce flux leakage, a U-shaped yoke 39 may be additionally provided as depicted in FIG. 7B. In this case, the yoke 39 is provided to face each of the magnetic pole surfaces of the magnet 12 and cover the magnet 12 and the fixed contact terminals 22*a* and 22*b*.

Figure 8A:
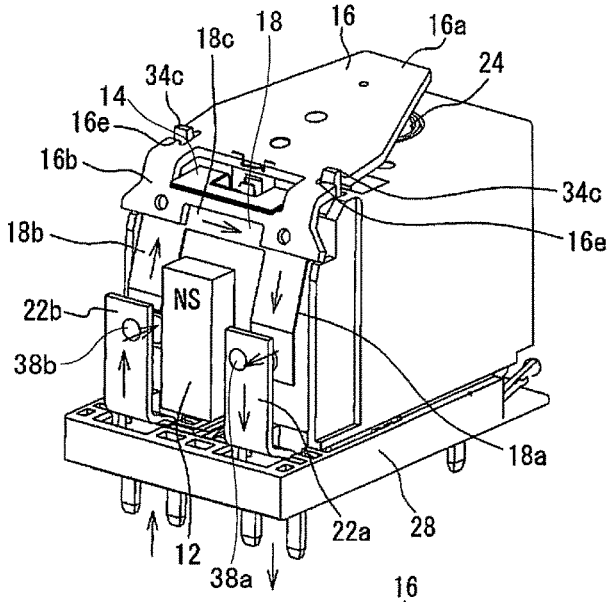
FIGS. 8A through 8C are diagrams depicting the electromagnetic relay according to the embodiment.
Figure 8B:
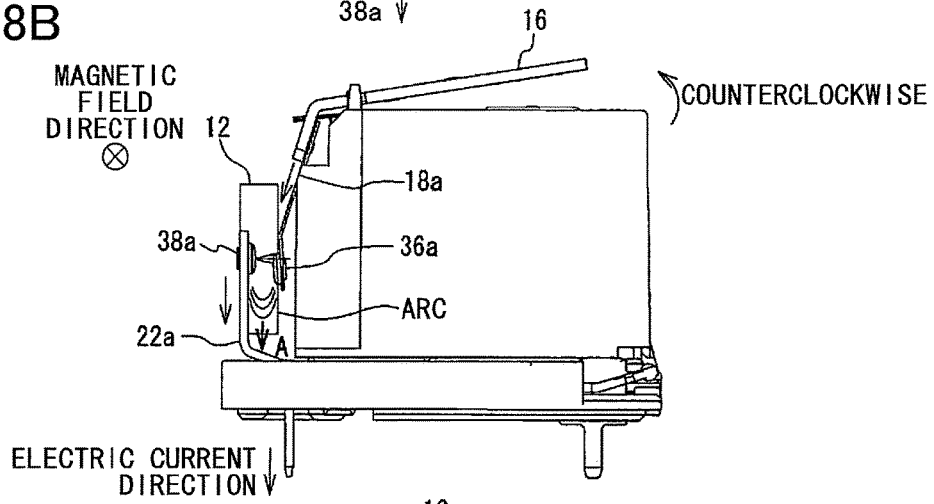
Figure 8C:
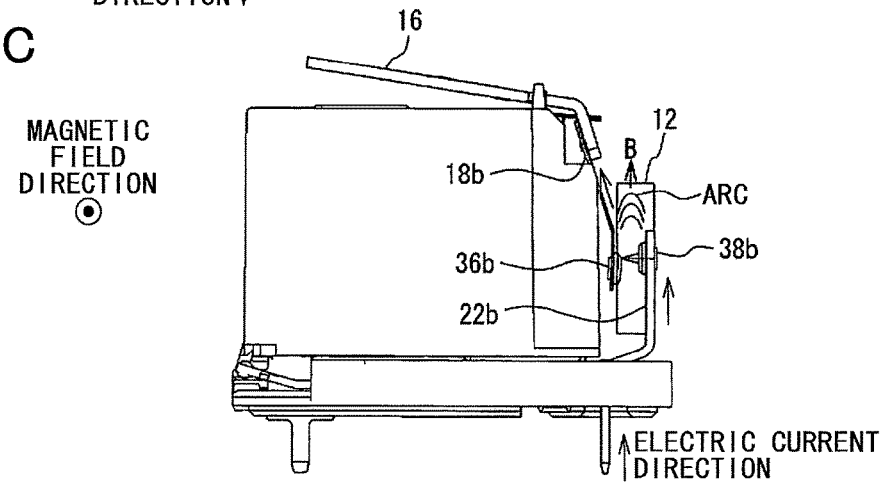

FIG. 8A is a diagram schematically depicting the direction of an electric current flowing through the relay 1 in the state where the fixed contacts 38*a* and 38*b* and the movable contacts 36*a* and 36*b* are out of contact. FIG. 8B is a diagram depicting the extinction of an arc in a view from the fixed contact terminal 22*a* side. FIG. 8C is a diagram depicting the extinction of an arc in a view from the fixed contact terminal 22*b* side. In FIGS. 8A through 8C, the direction of a flow of electric current is indicated by arrows.

According to the relay 1, one of the fixed contact terminals 22*a* and 22*b* is connected to a power supply, and the other of the fixed contact terminals 22*a* and 22*b* is connected to a load. When an electric current flows through the coil 30, the core 24 attracts the plate part 16*a* so that the armature 16 turns with the cuts 16*e* serving as a support of turning. As the armature 16 turns, the extending part 16*b* turns to cause the movable contacts 36*a* and 36*b* to contact the fixed contacts 38*a* and 38*b*, respectively. When the movable contacts 36*a* and 36*b* contact the fixed contacts 38*a* and 38*b* while voltage is applied to the fixed contact terminal 22*b*, the electric current flows from the fixed contact terminal 22*b* to the fixed contact terminal 22*a* through the fixed contact 38*b*, the movable contact 36*b*, the second movable piece 18*b*, the connecting part 18*c*, the first movable piece 18*a*, the movable contact 36*a*, and the fixed contact 38*a* as indicated by arrows in FIGS. 8A through 8C. When the electric current flowing in the coil 30 is turned off, the armature 16 turns counterclockwise by the restoring force of the hinge spring 14, as depicted in FIG. 8B. As the armature 16 turns, the movable contacts 36*a* and 36*b* move away from the fixed contacts 38*a* and 38*b*, respectively. However, because the electric current between the movable contact 36*a* and the fixed contact 38*a* and between the movable contact 36*b* and the fixed contact 38*b* is not completely interrupted, arcs may be generated between the movable contact 36*a* and the fixed contact 38*a* and between the movable contact 36*b* and the fixed contact 38*b*.

According to the relay 1 in FIGS. 8A through 8C, the direction of a magnetic field is the direction from the fixed contact terminal 22*a* to the fixed contact terminal 22*b*. Accordingly, the arc generated between the movable contact 36*a* and the fixed contact 38*a* is extended downward to a space below the contacts 36*a* and 38*a* by a Lorentz force as indicated by arrow A in FIG. 8B to be extinguished. Furthermore, the arc generated between the movable contact 36*b* and the fixed contact 38*b* is extended upward to a space above the contacts 36*b* and 38*b* by a Lorentz force as indicated by arrow B in FIG. 8C to be extinguished.

Figure 9A:
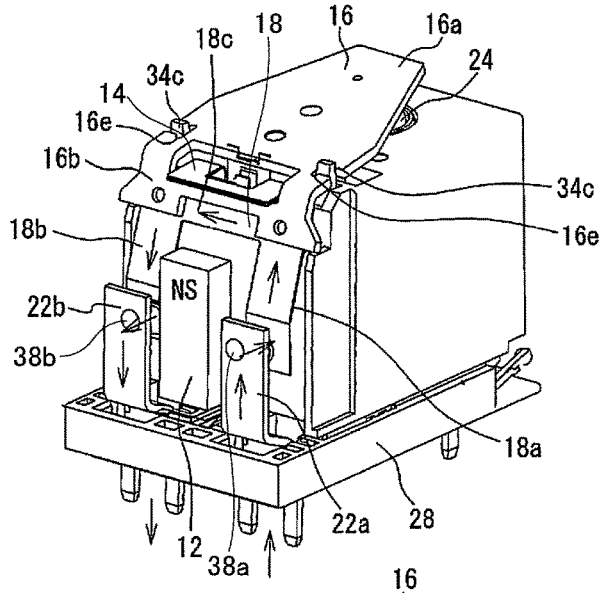
FIGS. 9A through 9C are diagrams depicting the electromagnetic relay according to the embodiment.
Figure 9B:
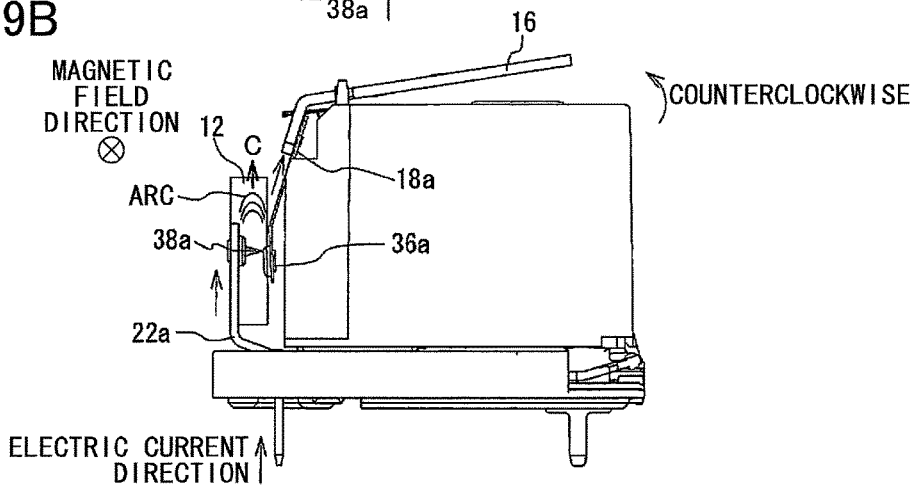
Figure 9C:
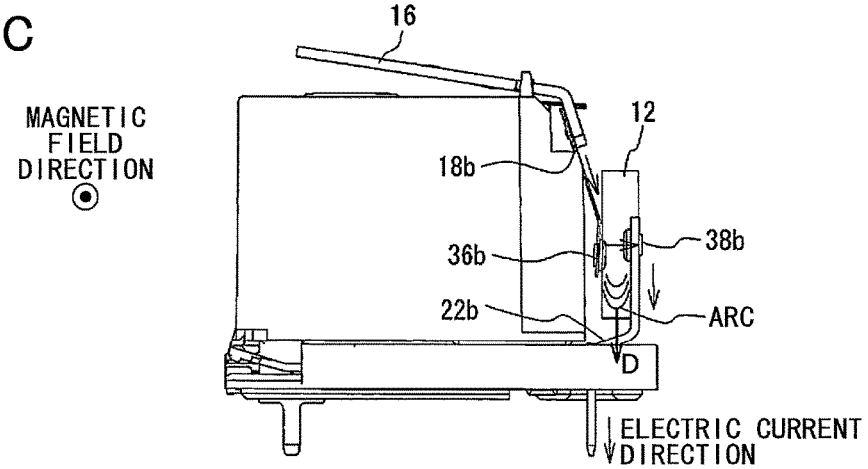

FIG. 9A is a diagram schematically depicting the direction of an electric current flowing through the relay 1. FIG. 9B is a diagram depicting the extinction of an arc in a view from the fixed contact terminal 22*a* side. FIG. 9C is a diagram depicting the extinction of an arc in a view from the fixed contact terminal 22*b* side. In FIGS. 9A through 9C, the electric current flows in a direction opposite to that in FIGS. 8A through 8C, and the direction of a flow of electric current is indicated by arrows.

When the movable contacts 36*a* and 36*b* contact the fixed contacts 38*a* and 38*b* while voltage is applied to the fixed contact terminal 22*a*, the electric current flows from the fixed contact terminal 22*a* to the fixed contact terminal 22*b* through the fixed contact 38*a*, the movable contact 36*a*, the first movable piece 18*a*, the connecting part 18*c*, the second movable piece 18*b*, the movable contact 36*b*, and the fixed contact 38*b* as indicated by arrows in FIGS. 9A through 9C. Even when the electric current flowing in the coil 30 is turned off, the electric current between the movable contact 36*a* and the fixed contact 38*a* and between the movable contact 36*b* and the fixed contact 38*b* is not completely interrupted. Therefore, arcs may be generated between the movable contact 36*a* and the fixed contact 38*a* and between the movable contact 36*b* and the fixed contact 38*b*.

According to the relay 1 in FIGS. 9A through 9C, the direction of a magnetic field is the direction from the fixed contact terminal 22*a* to the fixed contact terminal 22*b*. Accordingly, the arc generated between the movable contact 36*a* and the fixed contact 38*a* is extended upward to a space above the contacts 36*a* and 38*a* by a Lorentz force as indicated by arrow C in FIG. 9B to be extinguished. Furthermore, the arc generated between the movable contact 36*b* and the fixed contact 38*b* is extended downward to a space below the contacts 36*b* and 38*b* by a Lorentz force as indicated by arrow D in FIG. 9C to be extinguished.

Thus, as illustrated in FIGS. 8A through 8C and 9A through 9C, the relay 1 according to this embodiment is capable of simultaneously extinguishing the arc generated between the movable contact 36*a* and the fixed contact 38*a* and the arc generated between the movable contact 36*b* and the fixed contact 38*b* by extending the arcs to spaces in opposite directions, irrespective of the direction of the electric current flowing between the movable contact 36*a* and the fixed contact 38*a* and between the movable contact 36*b* and the fixed contact 38*b*.

Furthermore, the cuts 16*e* to which the movable contact spring 18 is attached is positioned above the movable contacts 36*a* and 36*b* and the fixed contacts 38*a* and 38*b*, and the lower parts 22*d* of the fixed contact terminals 22*a* and 22*b* are positioned below the movable contacts 36*a* and 36*b* and the fixed contacts 38*a* and 38*b*. Accordingly, spaces for extending arcs are reserved, whether the arc generated between the movable contact 36*a* and the fixed contact 38*a* and the arc generated between the movable contact 36*b* and the fixed contact 38*b* are extended upward or downward in accordance with the direction of the electric current flowing between the movable contact 36*a* and the fixed contact 38*a* or the movable contact 36*b* and the fixed contact 38*b*.

Figure 10B:
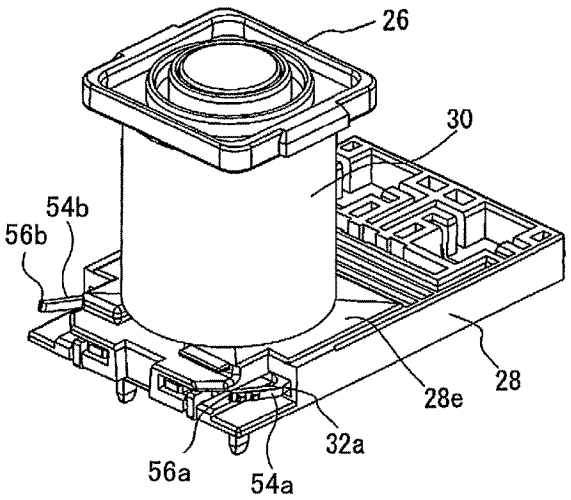
FIGS. 10A through 10D are diagrams depicting a base and coil terminals.
Figure 10D:
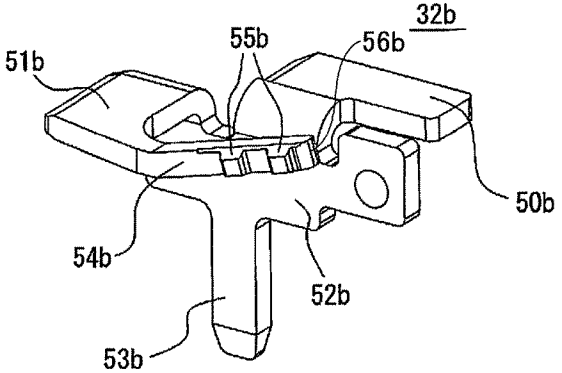
Figure 10A:
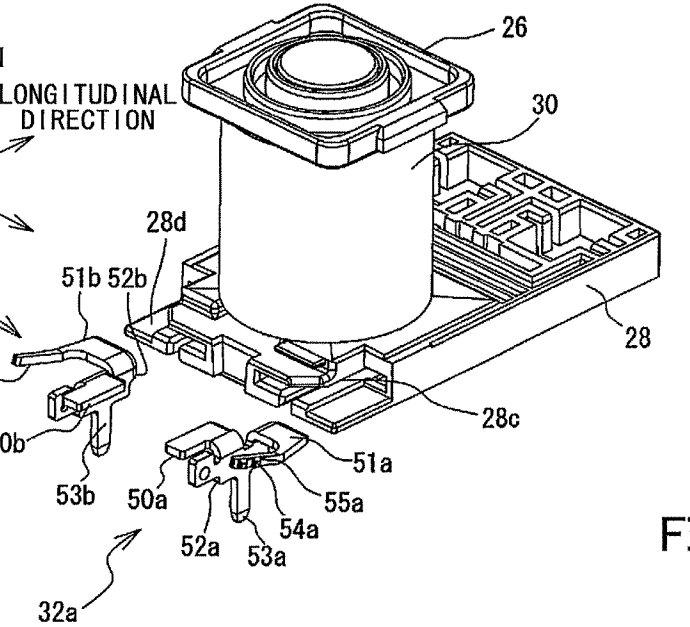
Figure 10C:
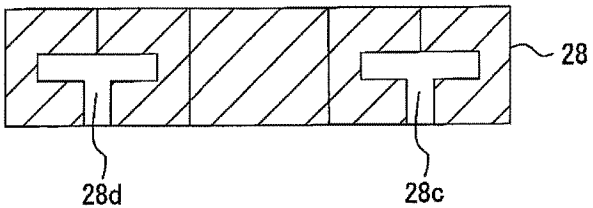

FIG. 10A is a schematic diagram depicting the base 28 and the coil terminals 32. FIG. 10B is a diagram depicting the base 28 into which the coil terminals 32 are press-fit. FIG. 10C is a rear view of the base 28. FIG. 10D is a diagram depicting one of the coil terminals 32.

Referring to FIGS. 10A through 10C, the coil terminals 32*a* and 32*b* are press-fit into T-shaped holes 28*c* and 28*d*, respectively, which are formed in a rear surface of the base 28.

Each of the coil terminals 32*a* and 32*b* is formed by bending a single metal plate. The coil terminal 32*a* includes a first horizontal part 50*a* and a second horizontal part 51*a*, which restrict the vertical movements of the coil terminal 32*a*, and a vertical part 52*a*, which restricts the horizontal movements of the coil terminal 32*a*. The first horizontal part 50*a* and the second horizontal part 51*a* extend from the top of the vertical part 52*a* and horizontally extend in opposite directions. Furthermore, the first horizontal part 50*a* and the second horizontal part 51*a* are offset in the longitudinal direction.

The coil terminal 32*a* further includes a leg 53*a*, a twining part 54*a*, and projections 55*a*. The leg 53*a* vertically extends downward from the vertical part 52*a* to connect to a power supply. The twining part 54*a* extends at an angle from an end of the second horizontal part 51*a*. The projections 55*a* define the wrapping position of the coil 30.

Like the coil terminal 32*a*, the coil terminal 32*b* includes a first horizontal part 50*b* and a second horizontal part 51*b* which restrict the vertical movements of the coil terminal 32*b*, and a vertical part 52*b* which restricts the horizontal movements of the coil terminal 32*b*, a leg 53*b* that vertically extends from the vertical part 52*b* to connect to the power supply, a twining part 54*b* that extends at an angle from an end of the second horizontal part 51*b*, and projections 55*b* defines the wrapping position of the coil 30.

Referring to FIG. 10B, the twining parts 54*a* and 54*b* are projecting from the base 28 and exposed, when the coil terminals 32*a* and 32*b* are press-fit into the base 28. An end 56*a* of the twining part 54*a* and an end 56*b* of the twining part 54*b* are preferably positioned lower than an upper surface 28*e* of the base 28. When the end 56*a* of the twining part 54*a* and the end 56*b* of the twining part 54*b* are positioned lower than the upper surface 28*e*, the wire can be wrapped around the spool 26 without paying attention to the twining parts 54*a* and 54*b*.

Because the twining parts 54*a* and 54*b* extend at an acute angle from horizontal portions of the coil terminals 32*a* and 32*b*, respectively, it is possible to reserve a space required for wrapping the coil 30 around the spool 26. Furthermore, according to the coil terminals 32*a* and 32*b*, a twining part does not need to be bent back when wrapping wire. Therefore, the slack or breakage of the coil 30 that may occur when bending back a twining part can be avoided.

Figure 11C:
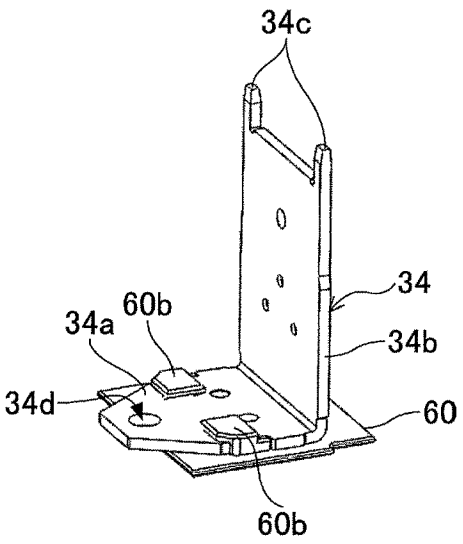
FIGS. 11A through 11C are diagrams depicting a yoke and a bottom plate.
Figure 11B:
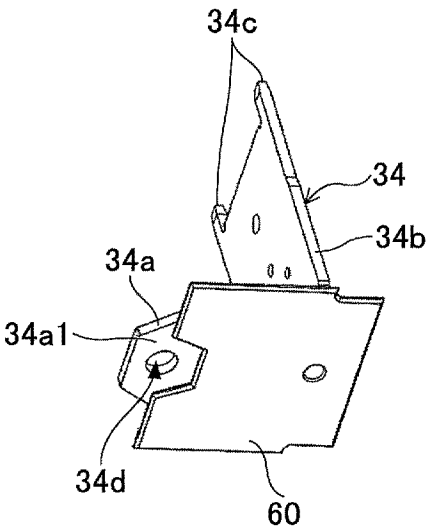
Figure 11A:
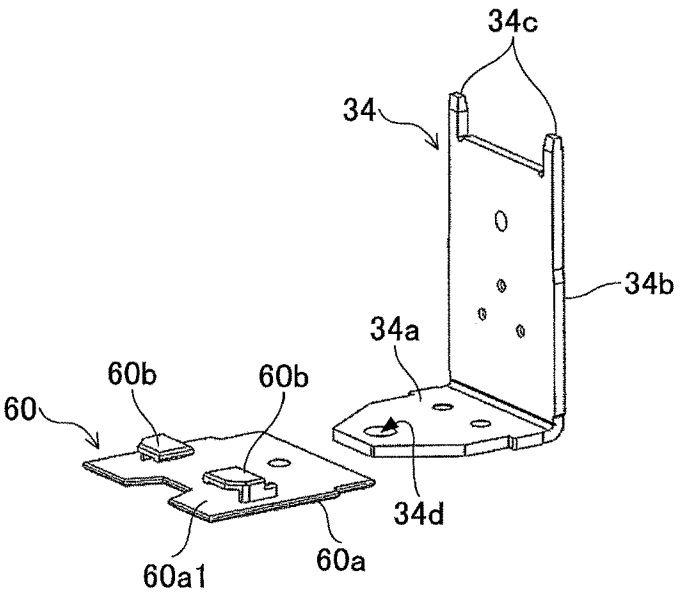

FIG. 11A is a diagram depicting the yoke 34 and the bottom plate 60. FIGS. 11B and 11C are a bottom-side perspective view and a top-side perspective view, respectively, of the yoke 34 to which the bottom plate 60 is connected. Referring to FIGS. 11A through 11C, according to the relay 1 of this embodiment, the bottom plate 60 is connected to the yoke 34 to cover the horizontal part 34*a*. The bottom plate 60 is formed of an insulator, such as a resin material. The bottom plate 60 includes a bottom part 60*a* and two insertion parts 60*b*. The bottom part 60*a* covers a lower surface 34*a*1 of the horizontal part 34*a*. When the relay 1 is mounted on a board, the lower surface 34*a*1 faces toward the board. The insertion parts 60*b* are provided on an upper surface 60*a*1 of the bottom part 60*a* which faces away from the board when the relay 1 is mounted on the board. By horizontally inserting the horizontal part 34*a* into the insertion parts 60*b*, the bottom plate 60 is attached to the horizontal part 34*a* to cover most of the lower surface 34*a*1 of the horizontal part 34*a*.

When part of the yoke 34 is exposed on its board side, it is necessary to cover the exposed part with an adhesive to insulate the yoke 34 from the board. In contrast, according to this embodiment, the yoke 34 can be easily insulated from the board by attaching the bottom plate 60 to the horizontal part 34*a*. Accordingly, it is possible to simplify the manufacturing process.

Furthermore, the horizontal part 34*a* is inserted into the two insertion parts 60*b* in a direction parallel to the horizontal part 34*a*. Therefore, the horizontal part 34*a* is prevented from vertically disengaging from the bottom plate 60. Accordingly, even when the relay 1 is turned bottom side up during the mounting of the relay 1 on the board, the horizontal part 34*a* does not disengage from the bottom plate 60.

Furthermore, as described below, according to this embodiment, it is possible to reduce the use of an adhesive, and accordingly, to increase the reliability.

Figure 12:
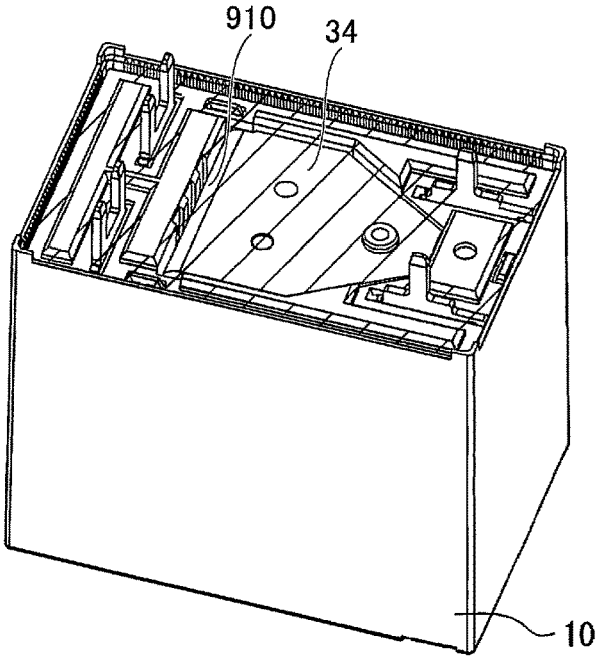
FIG. 12 is a diagram depicting an electromagnetic relay without the bottom plate.

A case in which the bottom plate 60 is not used is described with reference to FIG. 12. FIG. 12 is a diagram depicting a relay in which the bottom plate 60 is not provided. In this case, the yoke 34 is exposed at the lower surface of the relay. Therefore, in order to ensure the insulation between the board and the relay, an adhesive 910 (indicated by oblique lines) needs to be applied to cover the board-side region of the relay including the entire surface of the yoke 34, as depicted in FIG. 12. In the case of thus applying an adhesive on the entire bottom surface of the relay, the use of an adhesive increases to incur a cost increase. Furthermore, if the cured adhesive is hard, the weatherability may decrease to cause generation of cracks.

According to this embodiment, because most of the lower surface 34*a*1 of the horizontal part 34*a* is covered with the bottom plate 60, the use of an adhesive can be decreased, and it is possible to decrease cost and improve the weatherability.

According to this embodiment, the bottom plate 60 is attached to the yoke 34, and a projection 24*b* of the core 24 is fit into a hole 34*d* formed in the horizontal part 34*a*, and pressed and deformed to hold the horizontal part 34*a* against the core 24 to connect the core 24 to the yoke 34. Therefore, the bottom plate 60 is so shaped as not to cover the hold 34*d* when connected to the horizontal part 34*a* as depicted in FIG. 11B.

Figure 13:
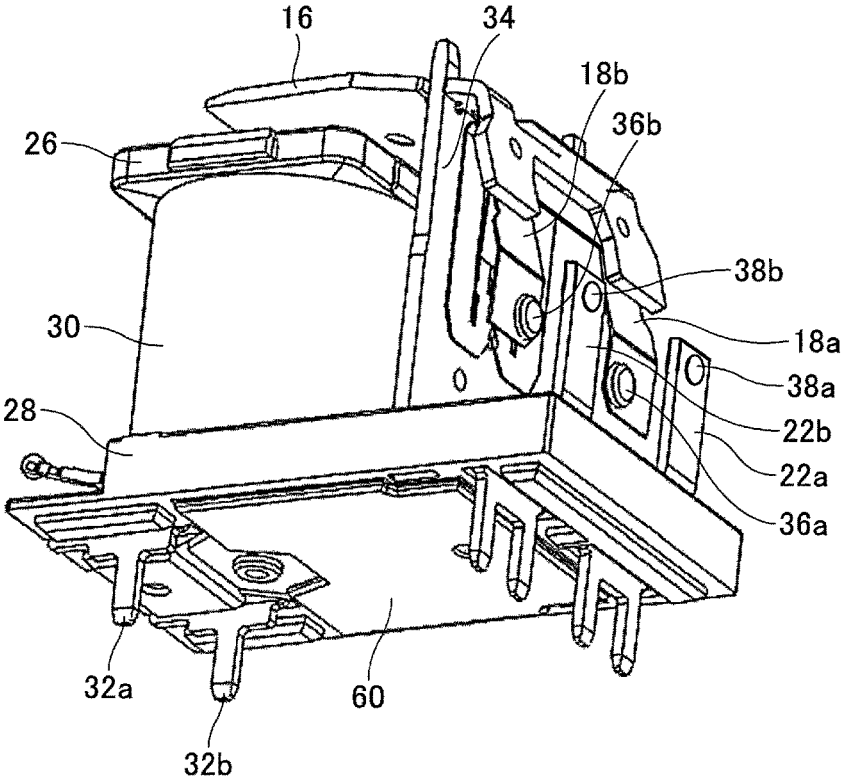
FIG. 13 is a perspective view of the electromagnetic relay according to the embodiment.
Figure 14:
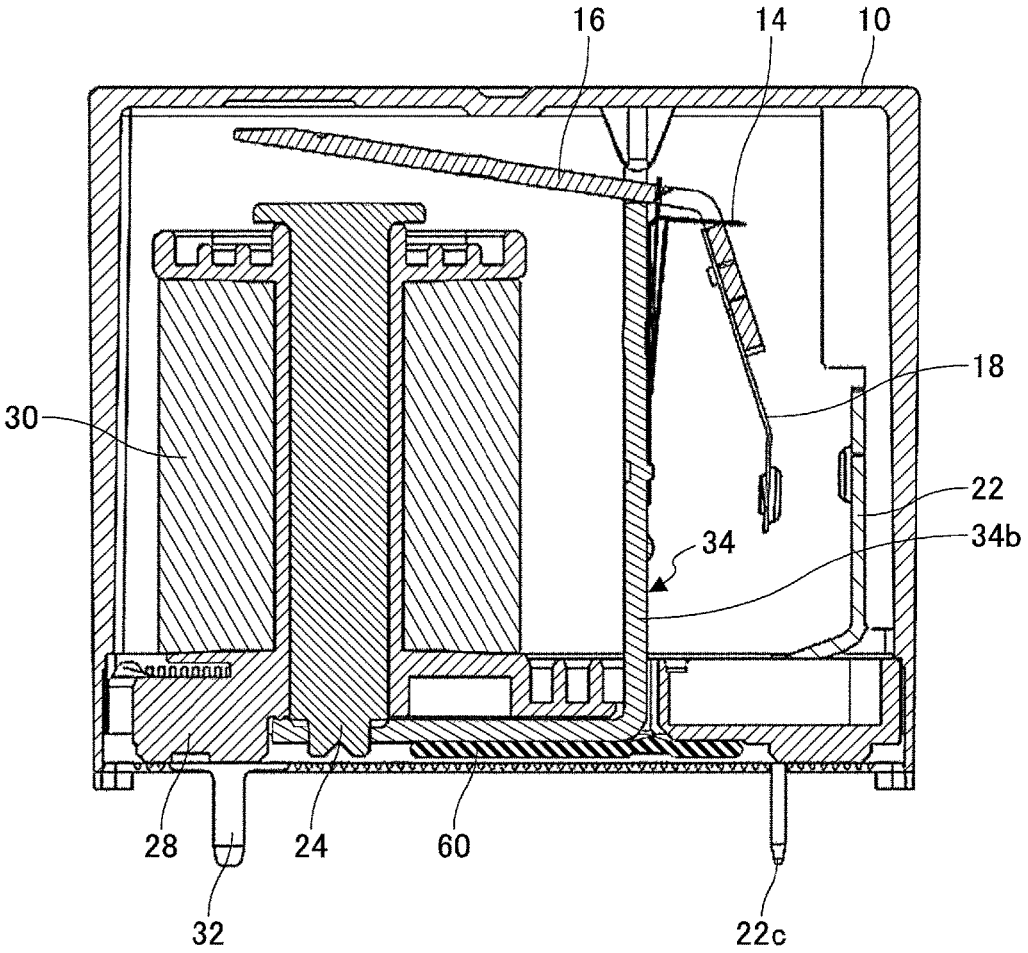
FIG. 14 is a cross-sectional view of the electromagnetic relay according to the embodiment.
Figure 15A:
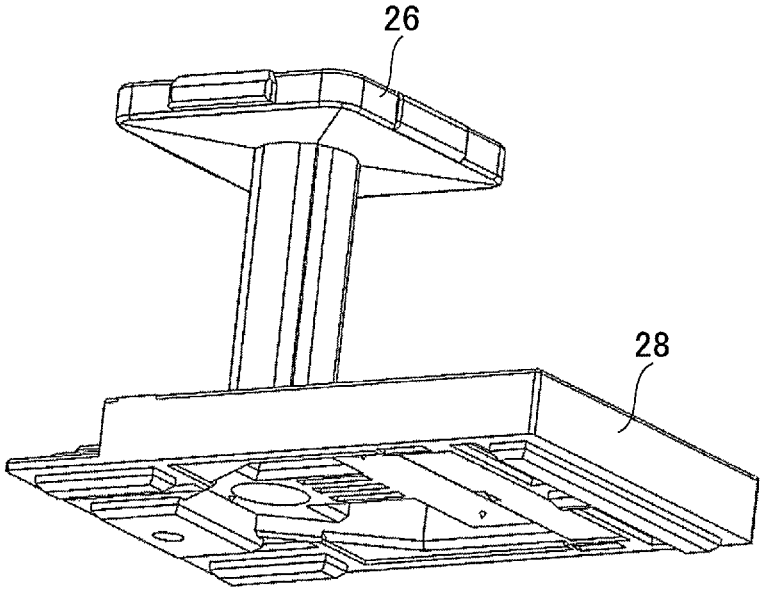
FIGS. 15A and 15B are perspective views of the base and a spool that are connected.
Figure 15B:
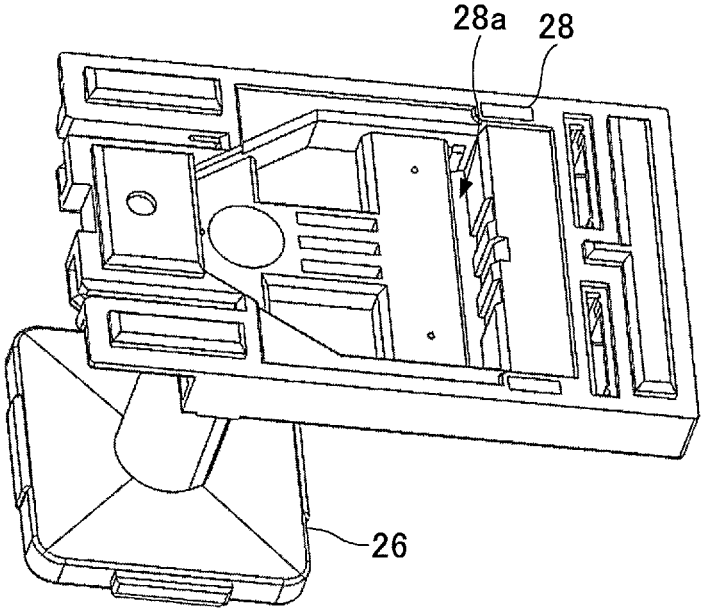

FIG. 13 is a perspective view of the relay 1 without the case 10 and the cover 20. FIG. 14 is a cross-sectional view of the relay 1 without the cover 20. FIG. 15A is a perspective view of the base 28 and spool 26, and FIG. 15B is a perspective bottom view of the base 28 and spool 26.

According to this embodiment, the yoke 34 may be provided on the base 28 by inserting the vertical part 34*b* of the yoke 34 to which the bottom plate 60 is connected into an opening 28*a* formed in the base 28. As depicted in FIG. 13, the bottom plate 60 is positioned at a bottom surface of the relay 1. Thereafter, by incorporating the other parts, the relay 1 is manufactured.

Figure 16A:
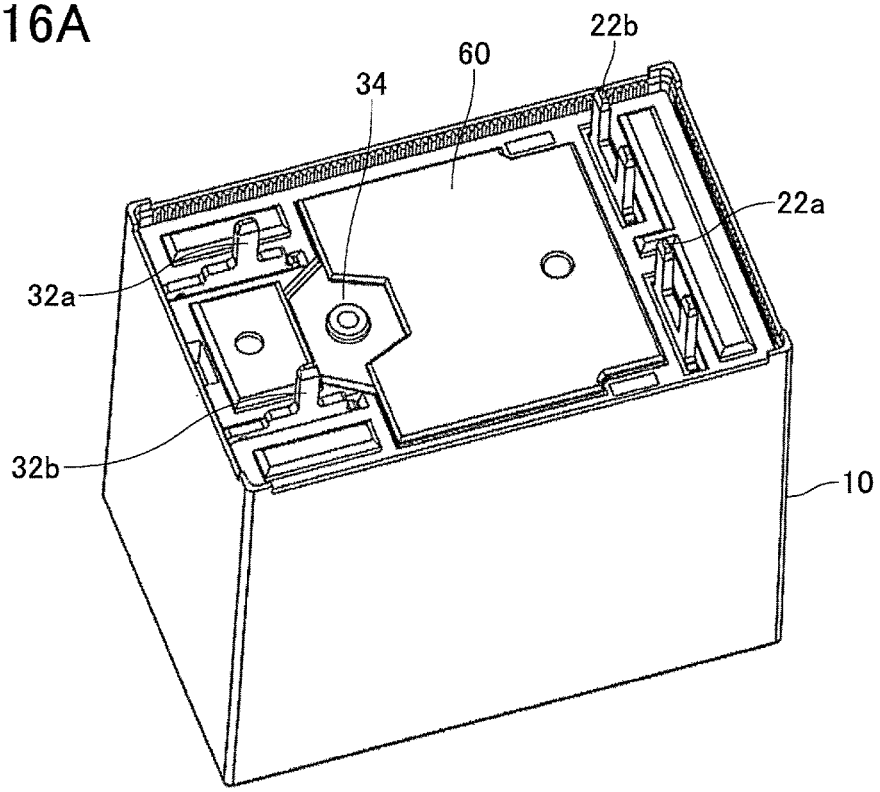
FIGS. 16A and 16B are diagrams depicting the electromagnetic relay before and after application of an adhesive.
Figure 16B:
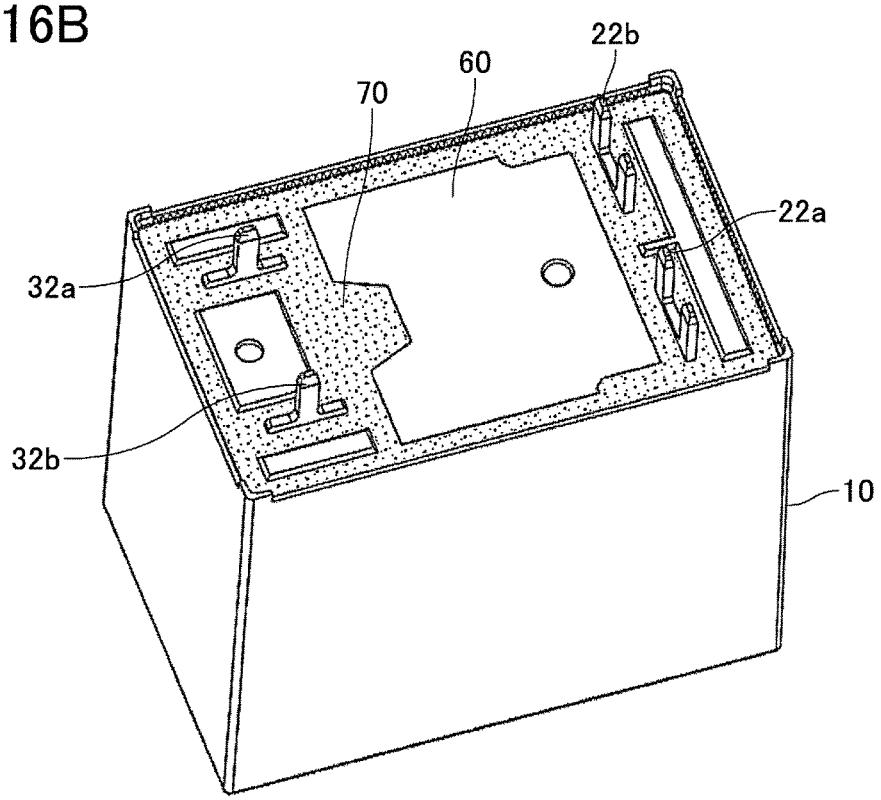

FIG. 16A is a diagram depicting the relay 1 before an adhesive 70 is applied, and FIG. 16B is a diagram depicting the relay 1 after the adhesive 70 is applied and cured. As depicted in FIG. 16B, the adhesive 70 is applied on the bottom surface of the relay 1 except for a region where the bottom plate 60 is positioned. The adhesive 70 is applied to part of the horizontal part 34*a* where the projection 24*b* is pressed and deformed.

Therefore, according to the relay 1 of this embodiment, an adhesive for insulating the yoke 34 is applied on a smaller area than in the relay of FIG. 12, and the use of an adhesive is reduced, so that it is possible to reduce cost and improve the weatherability. While epoxy resin may be used as the adhesive 70, it is possible to further improve the weatherability by using urethane resin, which is softer than epoxy resin.

Figure 17:
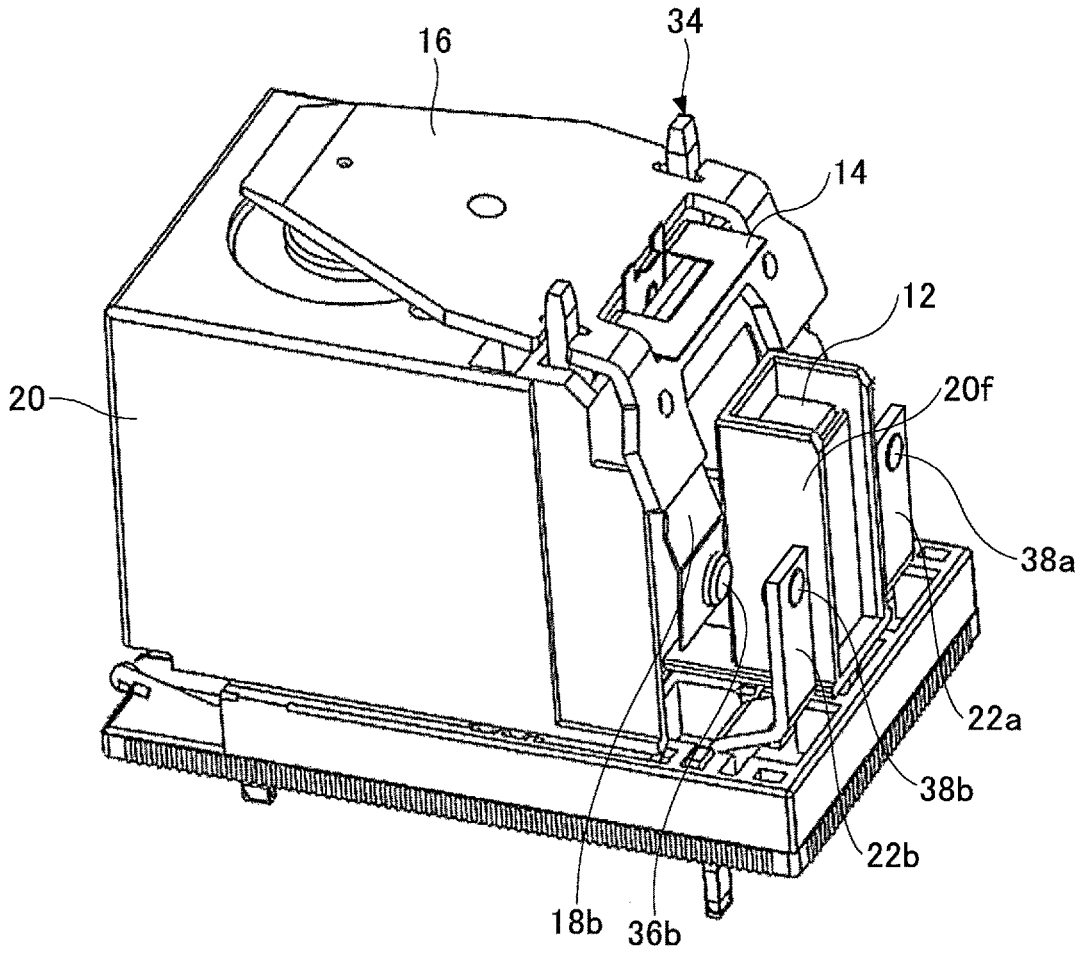
FIG. 17 is a perspective view of the electromagnetic relay according to a third variation of the embodiment.

FIG. 17 is a perspective view of the relay 1 according to a third variation of this embodiment. In the above-described embodiment, the case 10 includes the holder 101 for placing the magnet 12. Alternatively, an extension part 20*f* which has a U shape may be formed on the cover 20 to cover the magnet 12 on its three sides. The extension part 20*f* is interposed between the magnet 12 and the fixed contact 38*a* and the movable contact 36*a*, between the magnet 12 and the fixed contact 38*b* and the movable contact 36*b*, and between the magnet 12 and the yoke 34.

Figure 18:
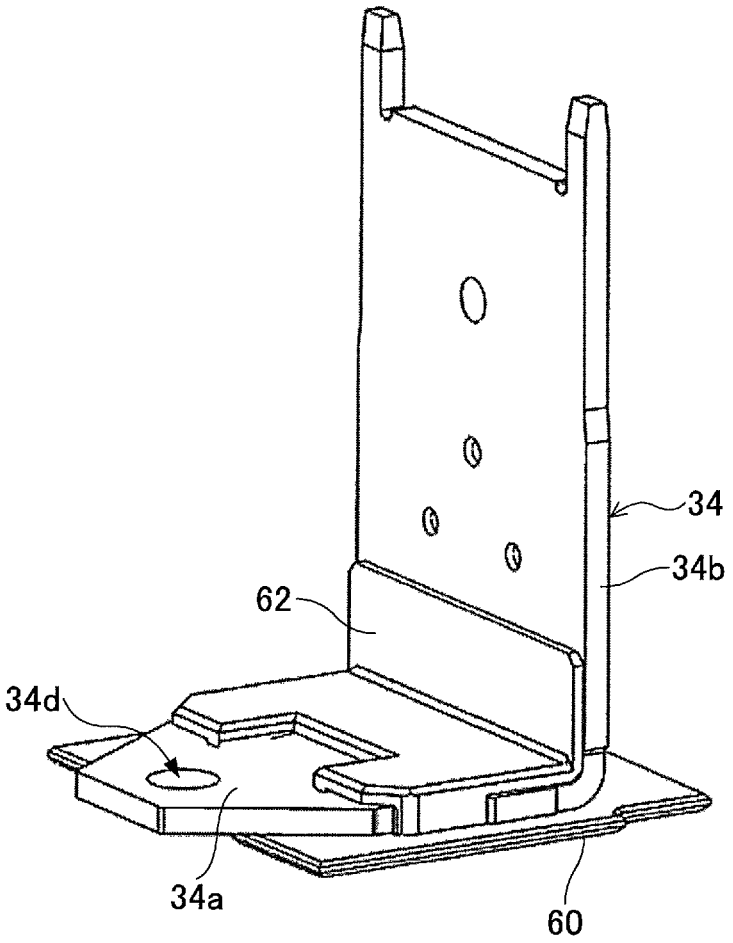
FIG. 18 is a perspective view of the yoke and a barrier according to a fourth variation of the embodiment.
Figure 19:
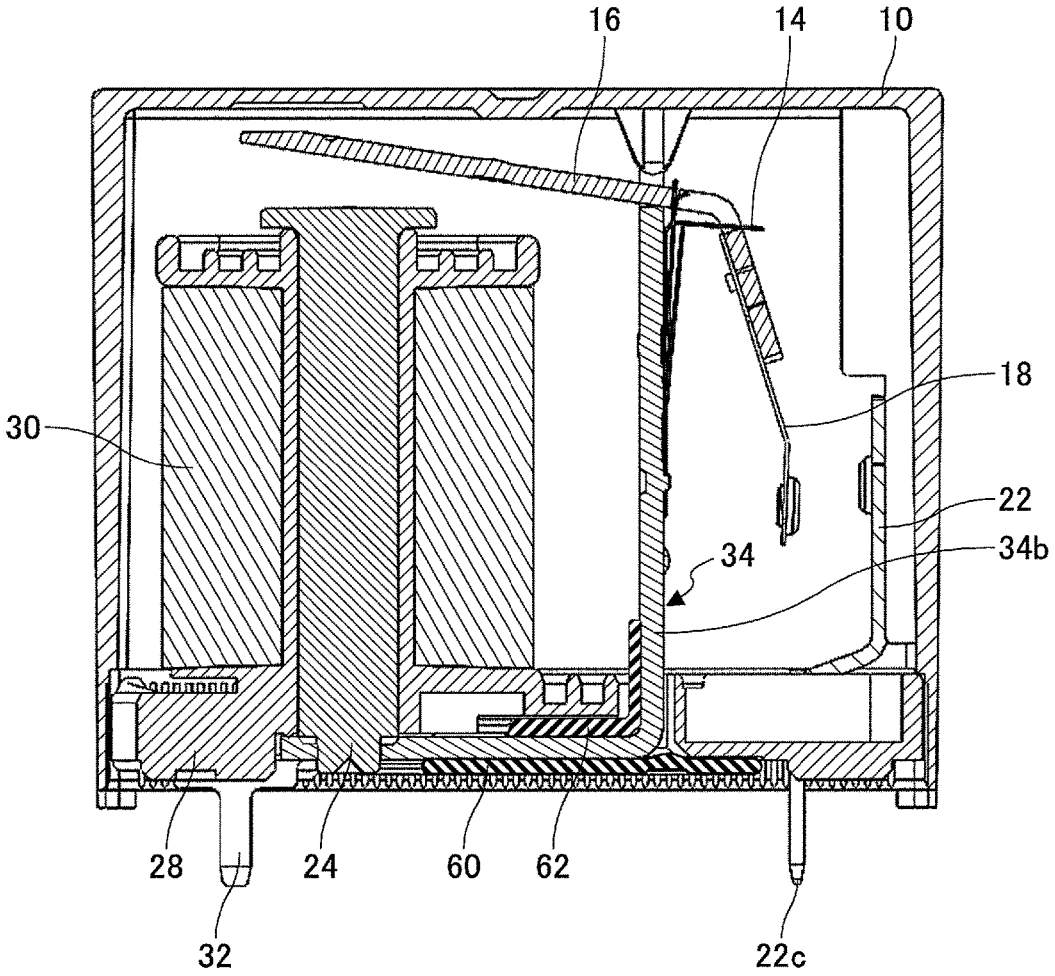
FIG. 19 is a cross-sectional view of the electromagnetic relay according to the fourth variation of the embodiment.
Figure 20:
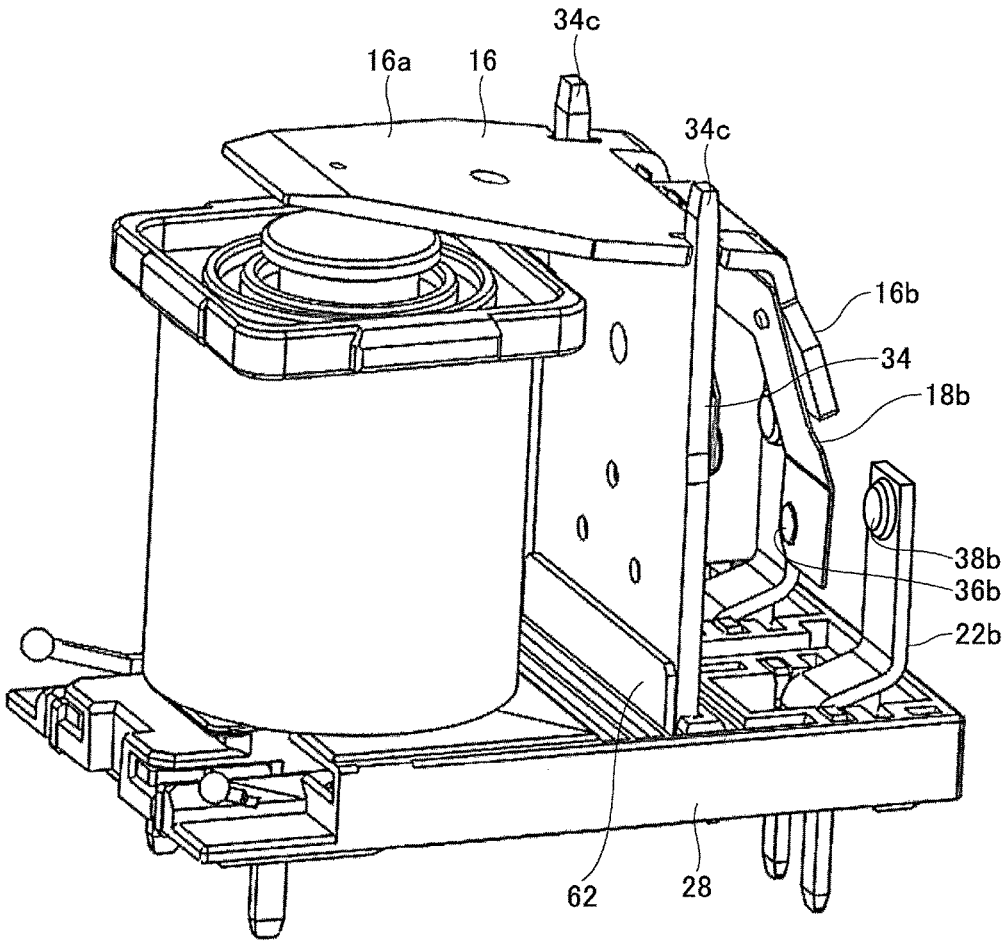
FIG. 20 is a perspective view of the electromagnetic relay according to the fourth variation of the embodiment.

According to a fourth variation of this embodiment, a barrier 62 monolithically formed with the bottom plate 60 may be disposed on a surface of the yoke 34 facing the coil 30. Because the barrier 62 as well is formed of an insulator, it is possible to more reliably insulate the yoke 34 and the coil 30 from each other. FIG. 18 is a perspective view of the yoke 34 to which the barrier 62 is connected. FIG. 19 is a cross-sectional view of the relay 1 according to this variation. FIG. 20 is a perspective view of the relay 1 without the case 10.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

What is claimed is:

1. An electromagnetic relay to be mounted on a board, comprising:

a base including a board-side surface that faces toward the board when the electromagnetic relay is mounted on the board;

a fixed contact terminal including a fixed contact, and fixed to the base;

a movable contact terminal including a movable contact that contacts the fixed contact;

an electromagnet including an iron core and a coil provided around the iron core, the electromagnet being configured to generate a magnetic field when an electric current flows through the coil;

an armature connected to the movable contact terminal, and moved by a magnetic force generated in the electromagnet;

a yoke including a vertical part, and a horizontal part connected to the iron core; and a bottom plate formed of an insulator, the bottom plate being attached to and covering the board-side surface of the base, the bottom plate including an insertion part into which the horizontal part is inserted in a direction parallel to the horizontal part.

2. The electromagnetic relay as claimed in claim 1, wherein the iron core is connected to the horizontal part with a part of the iron core inserted through an opening in the horizontal part being pressed and deformed to hold the horizontal part against the iron core.

3. The electromagnetic relay as claimed in claim 1, wherein an adhesive is applied on a surface of the horizontal part that faces toward the board when the electromagnetic relay is mounted on the board, the adhesive covering a part of the horizontal part connected to the iron core.

4. The electromagnetic relay as claimed in claim 1, further comprising:

an insulating cover that covers the coil and the yoke.

5. The electromagnetic relay as claimed in claim 4, further comprising:

a magnet for extinguishing an arc that is generated when the fixed contact and the movable contact are separated, wherein the insulating cover includes an extension that covers the magnet, and wherein the extension is interposed between the magnet and the fixed and movable contacts and between the magnet and the yoke.

6. The electromagnetic relay as claimed in claim 1, wherein the bottom plate includes a barrier that covers a surface of the yoke facing the coil.

7. The electromagnetic relay as claimed in claim 1, wherein the insertion part is provided on a surface of the bottom plate that faces away from the board when the electromagnetic relay is mounted on the board.

8. The electromagnetic relay as claimed in claim 7, wherein the horizontal part is inserted into the insertion part and held between the insertion part and the surface of the bottom plate.

* * * * *